US011646534B2

(12) United States Patent
Zhu et al.

(10) Patent No.: US 11,646,534 B2
(45) Date of Patent: May 9, 2023

(54) CABLE CONNECTOR

(71) Applicant: DONGGUAN LUXSHARE TECHNOLOGIES CO., LTD, Dongguan (CN)

(72) Inventors: Shangfeng Zhu, Dongguan (CN); Rongzhe Guo, Dongguan (CN); Tao Song, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 109 days.

(21) Appl. No.: 17/217,681

(22) Filed: Mar. 30, 2021

(65) Prior Publication Data

US 2021/0359472 A1 Nov. 18, 2021

(30) Foreign Application Priority Data

May 12, 2020 (CN) ..... 202010400294.2

(51) Int. Cl.

| | |
|---|---|
| ***H01R 13/648*** | (2006.01) |
| ***H01R 13/6585*** | (2011.01) |
| ***H01R 13/502*** | (2006.01) |
| ***H01R 13/6471*** | (2011.01) |

(52) U.S. Cl.
CPC ..... *H01R 13/6585* (2013.01); *H01R 13/502* (2013.01); *H01R 13/6471* (2013.01)

(58) Field of Classification Search
CPC ..... H01R 13/6585; H01R 13/6586; H01R 13/65; H01R 13/87; H01R 13/6588; H01R 13/6471; H01R 13/502
USPC ..... 439/108, 607.08
See application file for complete search history.

(56) References Cited

U.S. PATENT DOCUMENTS

2021/0359472 A1* 11/2021 Zhu ..... H01R 13/6471

FOREIGN PATENT DOCUMENTS

| | | | |
|---|---|---|---|
| CN | 2395427 | Y | 9/2000 |
| CN | 2599800 | Y | 1/2004 |
| CN | 1710752 | A | 12/2005 |
| CN | 201178210 | Y | 1/2009 |
| CN | 105191014 | A | 12/2015 |

(Continued)

OTHER PUBLICATIONS

Office Action issued in CN Application No. 202010400294.2 dated Jan. 27, 2021.

*Primary Examiner* — Khiem M Nguyen
(74) *Attorney, Agent, or Firm* — Birch, Stewart, Kolasch & Birch, LLP

(57) ABSTRACT

A cable connector includes a housing, a terminal module and a cable connected to the terminal module. The terminal module includes multiple groups of conductive terminals. At least one group of conductive terminals include two signal terminals, a first ground terminal and a second ground terminal. The at least one group of conductive terminals include a connecting portion connecting the first ground terminal and the second ground terminal. The cable includes signal wires electrically connected to the signal terminals and a ground shielding layer wrapped around a periphery of the signal wires. The connecting portion is at least partially wrapped and fixed on the ground shielding layer. With this arrangement, it is easy to connect the ground terminals and the cable ground shielding layer in order to achieve a better shielding effect.

20 Claims, 16 Drawing Sheets

(56) References Cited

FOREIGN PATENT DOCUMENTS

| | | | |
|---|---|---|---|
| CN | 105428860 | A | 3/2016 |
| CN | 109361116 | A | 2/2019 |
| CN | 110165448 | A | 8/2019 |
| JP | 2004-241176 | A | 8/2004 |
| TW | M251380 | U | 11/2004 |
| TW | M341978 | U | 10/2008 |
| WO | WO 2017/023756 | A1 | 2/2017 |

* cited by examiner

CABLE CONNECTOR

CROSS-REFERENCE TO RELATED APPLICATION

This patent application claims priority of a Chinese Patent Application No. 202010400294.2, filed on May 12, 2020 and titled "CABLE CONNECTOR", the entire content of which is incorporated herein by reference.

TECHNICAL FIELD

The present disclosure relates to a cable connector which belongs to a technical field of connectors.

BACKGROUND

Existing cable connectors, such as high-speed cable connectors, usually include signal terminals, two ground terminals located on both sides of the signal terminals, and cables. The cable includes signal wires connected to the signal terminals and two ground wires respectively connected to the two ground terminals. The shielding effect is improved by setting two ground wires, in an attempt to solve the problem of peripheral crosstalk caused by the signal terminals during signal transmission. It is well known that functions of the ground wires and functions of the signal wires are completely different. The ground wires are not allowed to contact the signal wires, otherwise it will cause a short circuit. Therefore, assembly processes of how to quickly and reliably connect the two grounding wires to the corresponding grounding terminals is complicated and the yield rate is low.

SUMMARY

An object of the present disclosure is to provide a cable connector in which it is easy to connect ground terminals and a cable ground shielding layer.

In order to achieve the above object, the present disclosure adopts the following technical solution: a cable connector comprising a housing having a slot; a terminal module received in the slot, the terminal module comprising a plurality of groups of conductive terminals, at least one group of conductive terminals comprising two signal terminals, a first ground terminal located on one side of the signal terminals and a second ground terminal located on the other side of the signal terminals; and a cable comprising signal wires electrically connected to the signal terminals; wherein each conductive terminal comprises a circuit board mounting portion for being mounted to a circuit board; wherein the at least one group of conductive terminals comprises a connecting portion connecting the first ground terminal and the second ground terminal; wherein the cable comprises a ground shielding layer wrapped around a periphery of the signal wires; and wherein the connecting portion is at least partially wrapped and fixed on the ground shielding layer.

In order to achieve the above object, the present disclosure adopts the following technical solution: a cable connector comprising a housing having a slot; a terminal module received in the slot, the terminal module comprising a plurality of groups of conductive terminals, at least one group of conductive terminals comprising two signal terminals, a first ground terminal located on one side of the signal terminals and a second ground terminal located on the other side of the signal terminals; and a cable comprising signal wires electrically connected to the signal terminals; wherein the at least one group of conductive terminals comprises a connecting portion connecting the first ground terminal and the second ground terminal; wherein the cable comprises a ground shielding layer wrapped around a periphery of the signal wires; wherein the connecting portion is at least partially wrapped and fixed on the ground shielding layer; and wherein the cable does not comprise any ground wire.

Compared with the prior art, the cable of the present disclosure includes a grounding shield layer wrapped around the periphery of the signal wires. The at least one group of conductive terminals includes a connecting portion connecting the first ground terminal and the second ground terminal. And, the connecting portion is at least partially wrapped and fixed on the ground shielding layer. With this arrangement, it is easy to connect the ground terminals and the cable ground shielding layer so as to achieve a better shielding effect.

DETAILED DESCRIPTION

Figure 1:
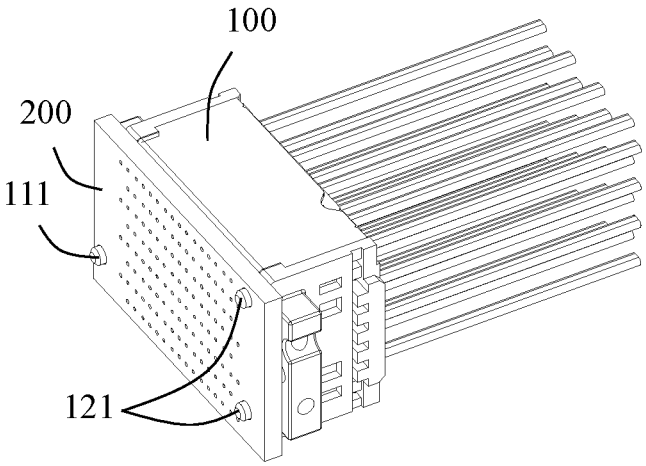
FIG. 1 is a perspective schematic of a cable assembly showing a cable connector mounted to a circuit board in accordance with an embodiment of the present disclosure.
Figure 2:
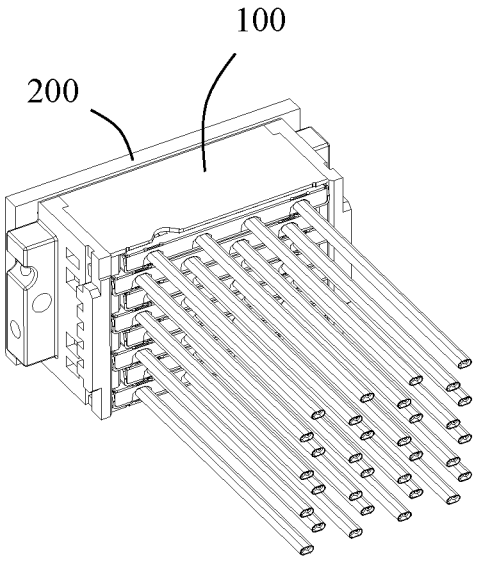
FIG. 2 is a perspective schematic view of FIG. 1 from another angle.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 4, an illustrated embodiment of the present disclosure discloses a cable connector 100 for connecting with a circuit board 200 so as to transmit high-speed signals. The cable connector 100 includes a housing 1 and a plurality of cable modules 2 mounted in the housing 1. The circuit board 200 is provided with a plurality of conductive holes 201.

The housing 1 includes a first side housing 11, a second side housing 12 opposite to the first side housing 11, and a metal shell 13 connecting the first side housing 11 and the second side housing 12. The first side housing 11, the second side housing 12 and the metal shell 13 are combined to form a whole. In addition, the first side housing 11 includes a first positioning post 111 protruding toward the circuit board 200 for passing through the circuit board 200. The second side housing 12 includes a second positioning post 121 protruding toward the circuit board 200 for passing through the circuit board 200. The first positioning post 111 and the second positioning post 121 are arranged asymmetrically, so as to play a role of fool-proof and avoid incorrectly assembling the cable connector 100 to the circuit board 200.

Figure 5:
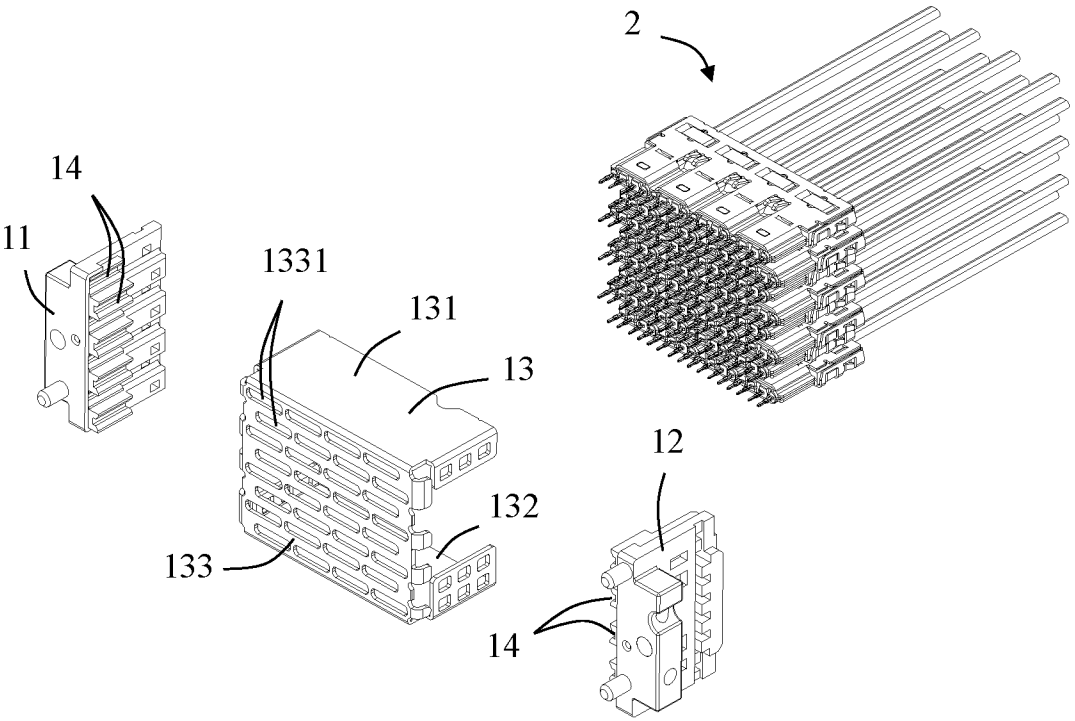
FIG. 5 is a further perspective exploded view of FIG. 4.
Figure 6:
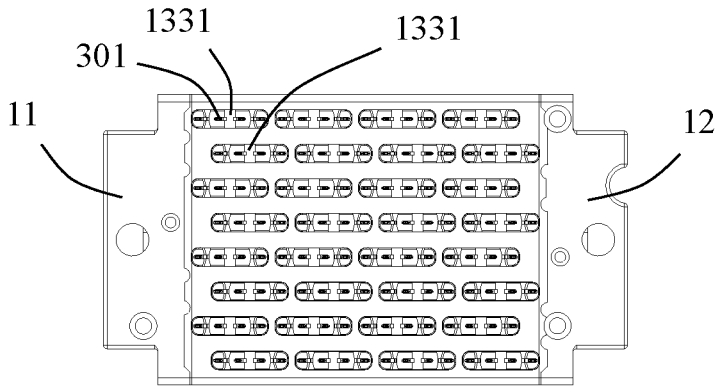
FIG. 6 is a left side view of the cable connector in FIG. 3.

Referring to FIGS. 5 and 6, the metal shell 13 includes a top wall 131, a bottom wall 132 and a front wall 133 connecting the top wall 131 and the bottom wall 132. The front wall 133 is provided with a plurality of rows of slots spaced apart along a vertical direction. Each row of slots includes a plurality of openings 1331. Two adjacent openings 1331 are arranged in a staggered manner along the vertical direction. In addition, inner walls of the first side housing 11 and the second side housing 12 are formed with a plurality of slots 14 for receiving the cable modules 2.

Figure 7:
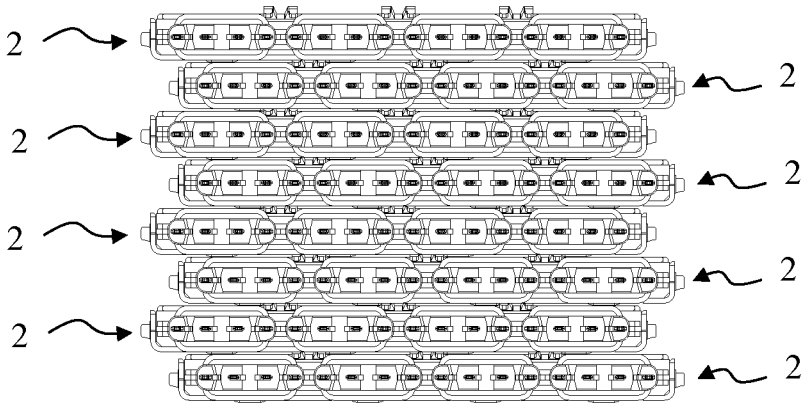
FIG. 7 is a left side view of the cable connector in FIG. 3 with the housing removed.

Referring to FIG. 7, the plurality of cable modules 2 are spaced apart along the vertical direction, and each adjacent two cable modules 2 along the vertical direction are arranged in a staggered manner.

Referring to FIGS. 8 to 13, each cable module 2 includes a terminal module 3, a cable 4 connected to the terminal module 3, a first metal shield 51 located on one side of the terminal module 3, and a second metal shield 52 located on the other side of the terminal module 3.

The first metal shield 51 and the second metal shield 52 jointly clamp the terminal module 3. The first metal shield 51 and the second metal shield 52 are in contact so as to form a relatively large shielding area. In an embodiment of the present disclosure, the first metal shield 51 and the second metal shield 52 are fixed together by spot welding. After the cable module 2 is assembled into the slot 14 of the housing 1, the first metal shield 51 and the second metal shield 52 are in contact with the metal shell 13 so as to further increase the shielding area and improve the quality of signal transmission.

Figure 8:
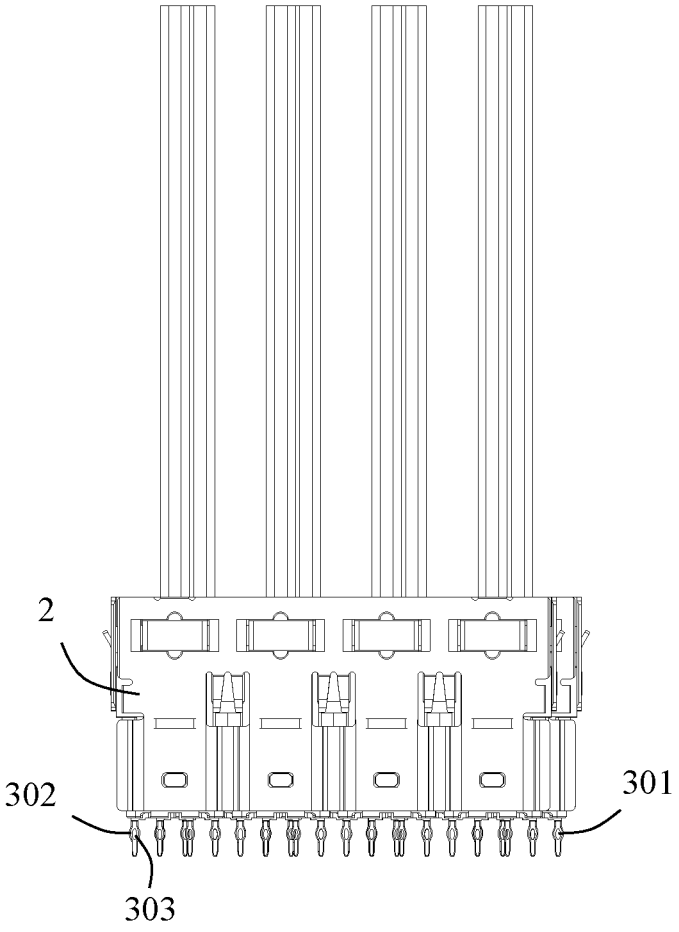
FIG. 8 is a top view of FIG. 7.
Figure 9:
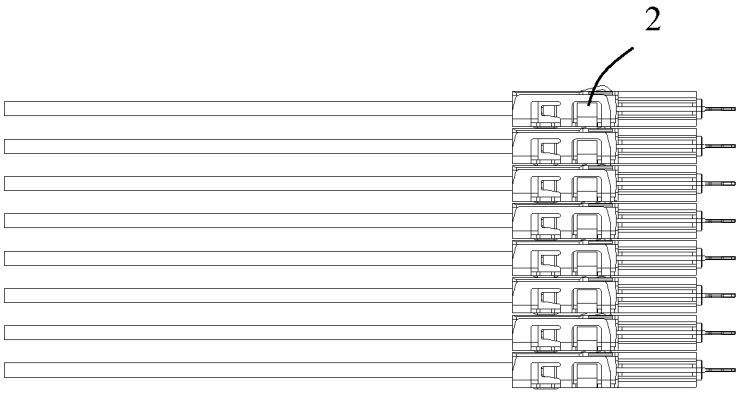
FIG. 9 is a left side view of FIG. 7.
Figure 10:
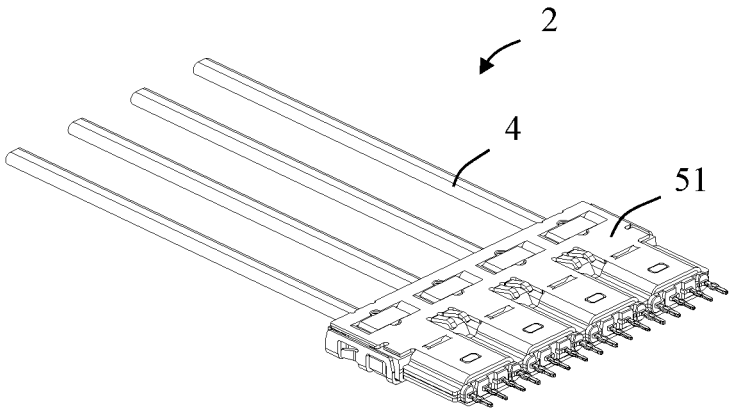
FIG. 10 is a perspective schematic view of a terminal module, a first metal shield, a second metal shield and a cable after being assembled.
Figure 11:
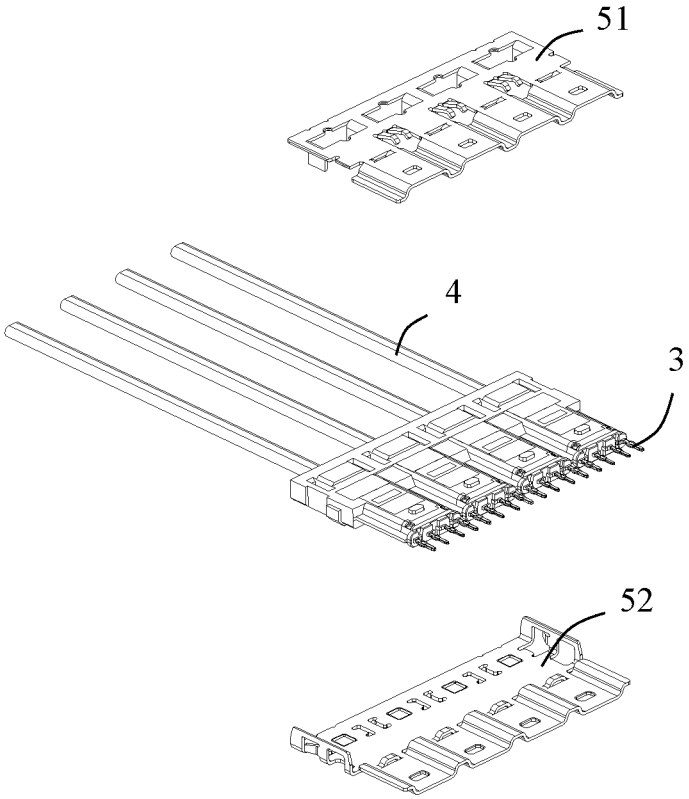
FIG. 11 is a partial perspective exploded view of FIG. 10, in which the first metal shield and the second metal shield are separated.
Figure 12:
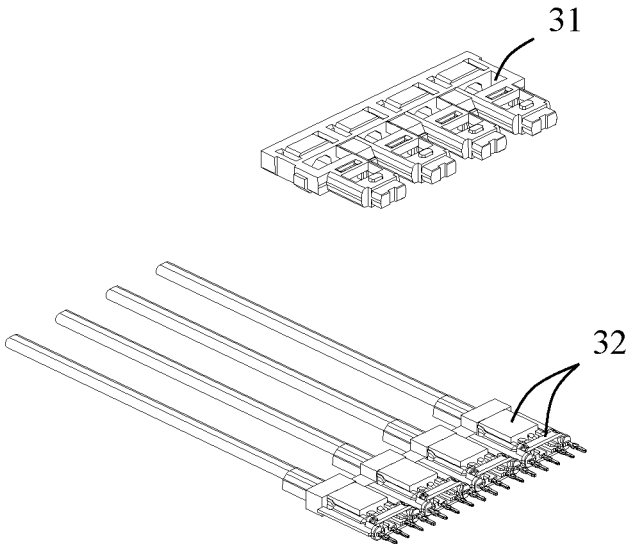
FIG. 12 is a further perspective exploded view after removing the first metal shield and the second metal shield in FIG. 11, in which the first insulating block is separated.
Figure 13:
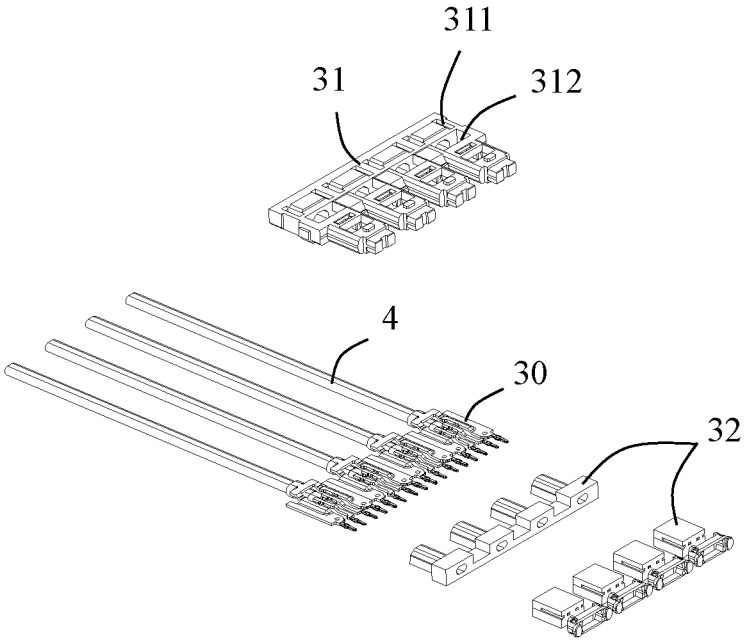
FIG. 13 is a further perspective exploded view of FIG. 12, in which the second insulating block is separated.

The terminal module 3 includes a plurality of groups of conductive terminals 30, a first insulating block 31 and a second insulating block 32. The conductive terminals 30 are insert-molded with the first insulating block 31 to form a first module. The first module is insert-molded with the second insulating block 32 to form a whole. Referring to FIG. 8, the first insulating block 31 includes a first hollow portion 311 and a second hollow portion 312 spaced apart from the first hollow portion 311.

Figure 3:
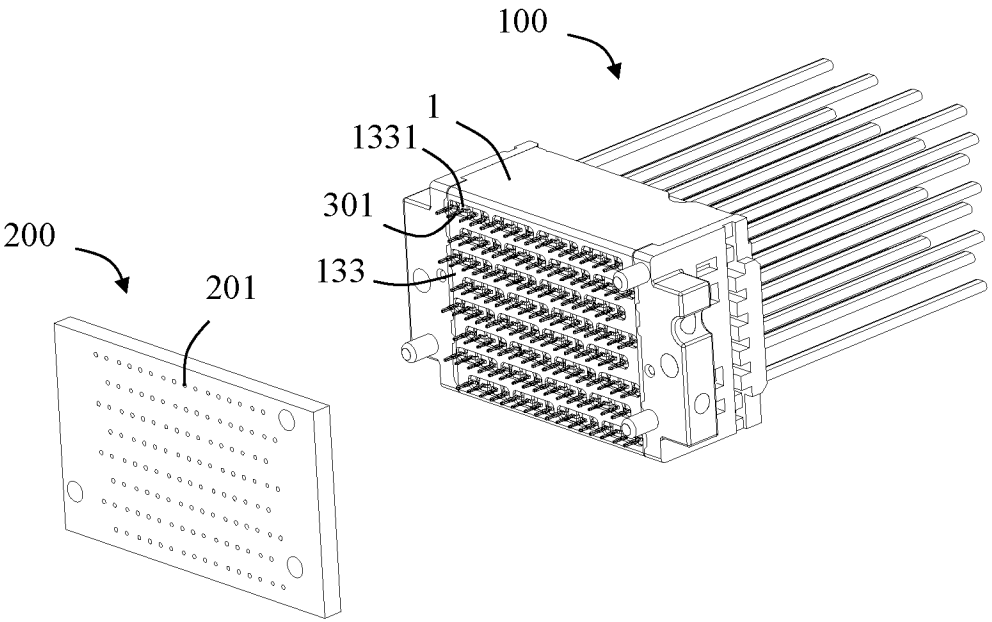
FIG. 3 is a partially exploded perspective view of FIG. 1.
Figure 4:
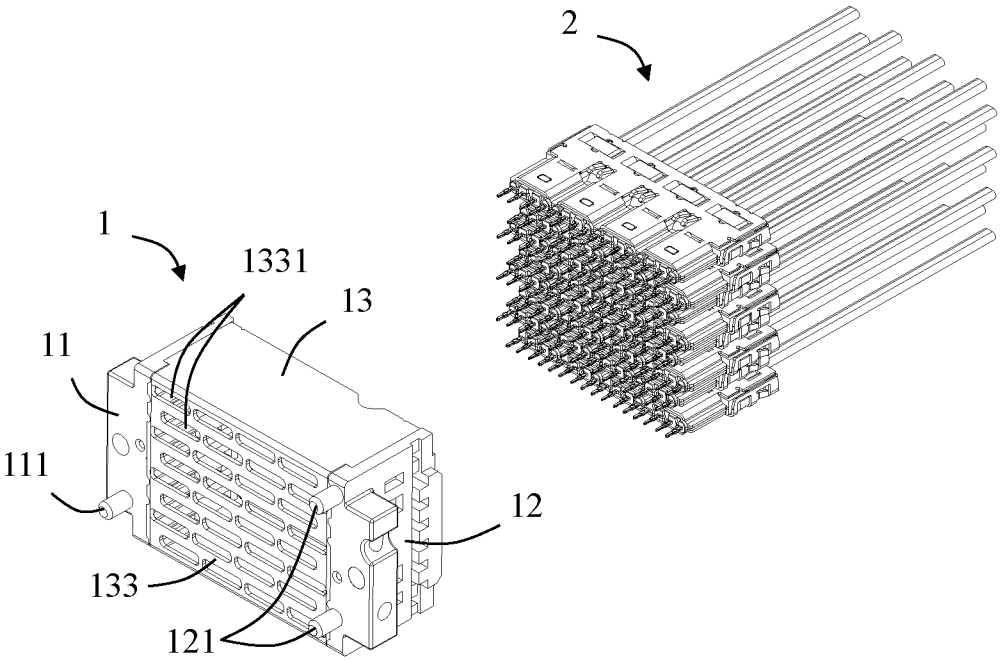
FIG. 4 is a partial perspective exploded view of the cable connector in accordance with an embodiment of the present disclosure.

Each group of conductive terminals 30 includes two signal terminals S, a first ground terminal G1 located on one side of the signal terminals S, and a second ground terminal G2 located on the other side of the signal terminals S. Each group of conductive terminals 30 includes a circuit board mounting portion 301 for being mounted on the circuit board 200. The circuit board mounting portion 301 passes through the opening 1331 of the metal shell 13 (as shown in FIG. 3). Referring to FIG. 8, the circuit board mounting portion 301 has a widened portion 302 for being pressed into the conductive hole 201 of the circuit board 200 and a through hole 303 extending through the widened portion 302. By providing the through hole 303, the widened portion 302 is capable of having a certain degree of flexibility. As a result, it facilitates to press the widened portions 302 into the conductive holes 201 of the circuit board 200. Of course, in other embodiments, the circuit board mounting portions 301 may also be connected to the circuit board by soldering.

Figure 14:
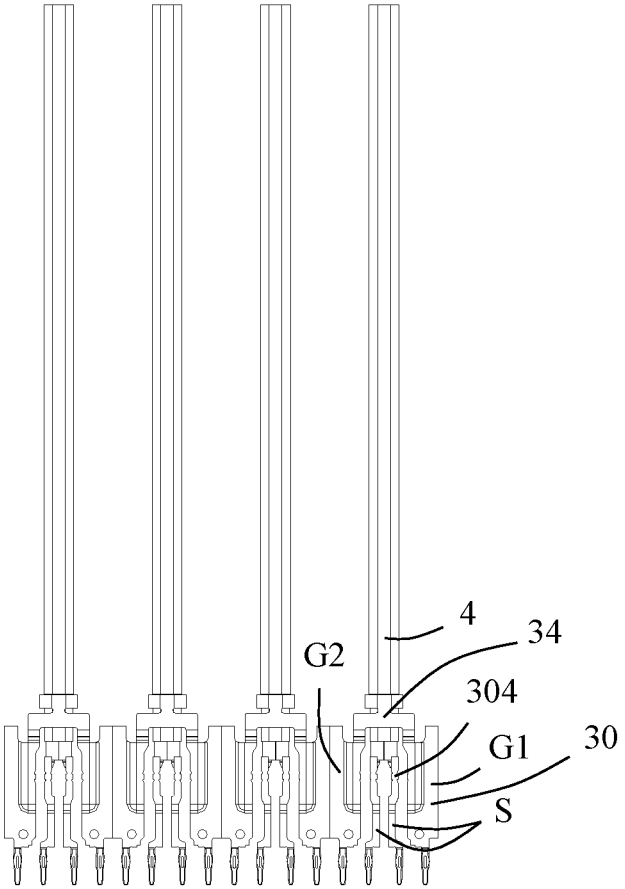
FIG. 14 is a top view of the conductive terminals in FIG. 13 when the cable is connected.
Figure 15:
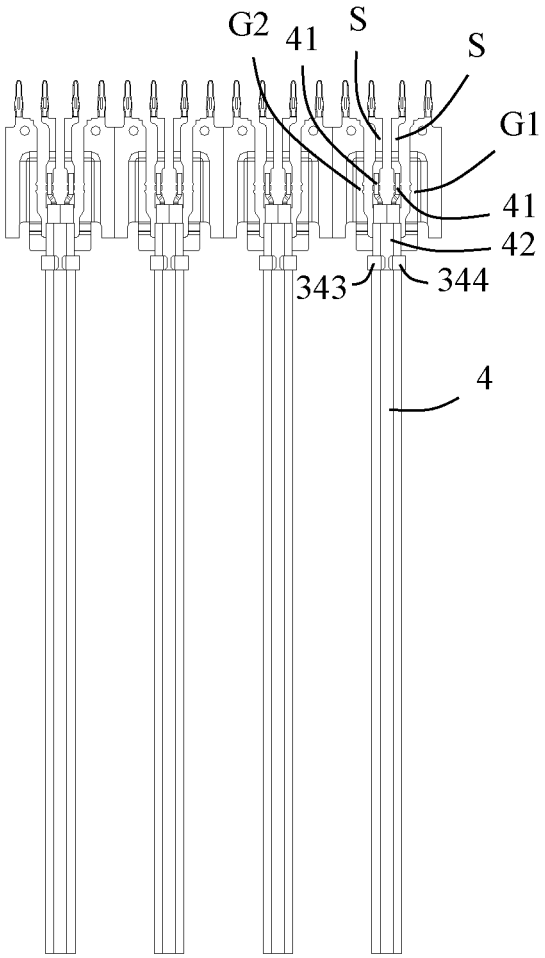
FIG. 15 is a bottom view of FIG. 14.
Figure 16:
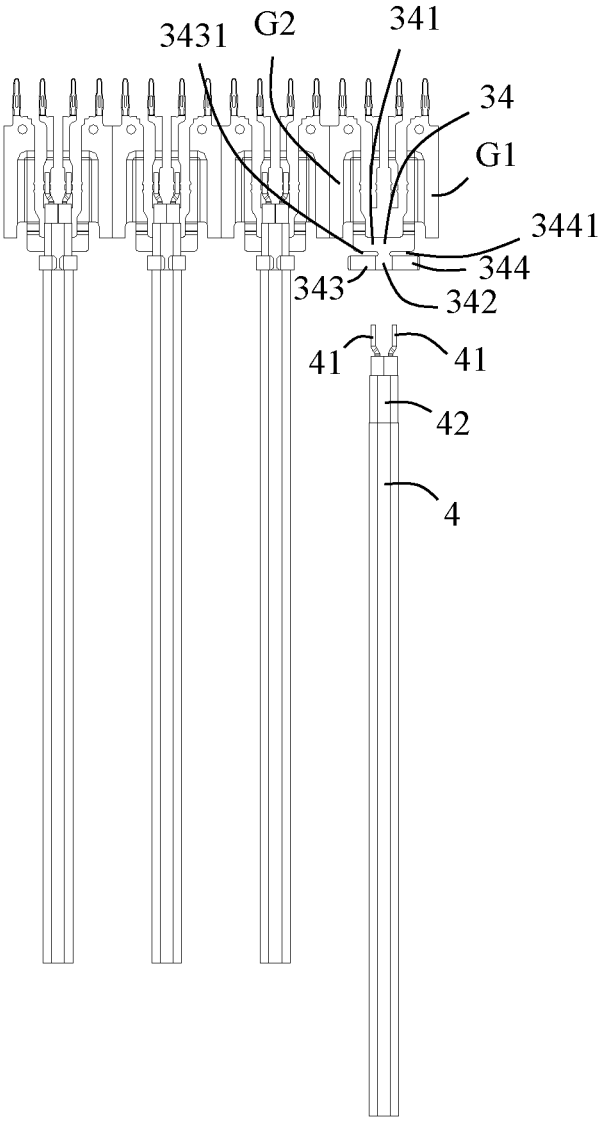
FIG. 16 is a partial exploded view of FIG. 15, which shows a schematic view of a cable and a group of conductive terminals before being assembled.

Referring to FIGS. 14 to 16, the cable 4 includes signal wires 41 electrically connected to the signal terminals S and a ground shielding layer 42 wrapped around a periphery of the signal wires 41. In the illustrated embodiment of the present disclosure, the cable 4 is not provided with any ground wire. This arrangement completely solves the short circuit problem caused by the mutual contact between the ground wires and the signal wires 41.

Referring to FIG. 16, each group of conductive terminals 30 include a connecting portion 34 connecting the first ground terminal G1 and the second ground terminal G2. The connecting portion 34 includes a bridge portion 341 connecting the first ground terminal G1 and the second ground terminal G2, a tail portion 342 extending from the bridge portion 341, and a first wing portion 343 and a second wing portion 344 extending in opposite directions from opposite sides of the tail portion 342. The first wing portion 343 and the second wing portion 344 are both parallel to the bridge portion 341. A first slit 3431 is formed between the first wing portion 343 and the bridge portion 341, and a second slit 3441 is formed between the second wing portion 344 and the bridge portion 341, thereby facilitating bending of the first wing portion 343 and the second wing portion 344.

The signal wires 41 and the signal terminals S are fixed by soldering. The connecting portion 34 and the ground shielding layer 42 are fixed in a non-soldering manner. Each signal terminal S includes a cable connection portion 304 exposed in the first hollow portion 311. The cable connection portions 304 and the signal wires 41 are electrically connected, for example, in a soldering manner. The first wing portion 343 and the second wing portion 344 are exposed in the second hollow portion 312. The first wing portion 343 and the second wing portion 344 are riveted and fixed on the ground shielding layer 42 so as to improve assembly efficiency and product yield.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A cable connector, comprising:

a housing having a slot;

a terminal module received in the slot, the terminal module comprising a plurality of groups of conductive terminals, at least one group of conductive terminals comprising two signal terminals, a first ground terminal located on one side of the signal terminals and a second ground terminal located on the other side of the signal terminals; and a cable comprising signal wires electrically connected to the signal terminals;

wherein each conductive terminal comprises a circuit board mounting portion for being mounted to a circuit board;

wherein the at least one group of conductive terminals comprises a connecting portion connecting the first ground terminal and the second ground terminal;

wherein the cable comprises a ground shielding layer wrapped around a periphery of the signal wires;

wherein the connecting portion is at least partially wrapped and fixed on the ground shielding layer;

wherein the connecting portion comprises a first wing portion and a second wing portion, the first wing portion and the second wing portion extend in opposite directions, and the first wing portion and the second wing portion are riveted and fixed on the ground shielding layer;

wherein the connecting portion comprises a bridge portion connecting the first ground terminal and the second ground terminal, and a tail portion extending from the bridge portion;

and wherein the first wing portion and the second wing portion extend from two sides of the tail portion, respectively; and wherein the first wing portion and the second wing portion are both parallel to the bridge portion, a first slit is formed between the first wing portion and the bridge portion, and a second slit is formed between the second wing portion and the bridge portion.

2. The cable connector according to claim 1, wherein the signal wires and the signal terminals are fixed in a soldering manner, and the connecting portion and the ground shielding layer are fixed in a non-soldering manner.

3. The cable connector according to claim 1, wherein the cable is not provided with any ground wire.

4. The cable connector according to claim 1, wherein the circuit board mounting portion comprises a widened portion for being pressed into conductive holes of the circuit board and a through hole extending through the widened portion.

5. The cable connector according to claim 1, wherein the terminal module comprises a first insulating block and a second insulating block, the conductive terminals are insert-molded with the first insulating block so as to form a first module, the first module is insert-molded with the second insulating block, the first insulating block comprises a first hollow portion and a second hollow portion spaced apart from each other, each signal terminal comprises a cable connection portion exposed in the first hollow portion to electrically connect the signal wire, and the first wing portion and the second wing portion are exposed in the second hollow portion.

6. The cable connector according to claim 5, further comprising a first metal shield located on one side of the terminal module and a second metal shield located on the other side of the terminal module, the first metal shield and the second metal shield jointly clamp the terminal module, and the first metal shield is in contact with the second metal shield.

7. The cable connector according to claim 6, wherein the housing comprises a first side housing, a second side housing opposite to the first side housing, and a metal shell connecting the first side housing and the second side housing, the slot is formed on inner walls of the first side housing and the second side housing, and the first metal shield and the second metal shield are in contact with the metal shell.

8. A cable connector, comprising:

a housing having a slot;

a terminal module received in the slot, the terminal module comprising a plurality of groups of conductive terminals, at least one group of conductive terminals comprising two signal terminals, a first ground terminal located on one side of the signal terminals and a second ground terminal located on the other side of the signal terminals; and a cable comprising signal wires electrically connected to the signal terminals;

wherein the at least one group of conductive terminals comprises a connecting portion connecting the first ground terminal and the second ground terminal;

wherein the cable comprises a ground shielding layer wrapped around a periphery of the signal wires;

wherein the connecting portion is at least partially wrapped and fixed on the ground shielding layer;

wherein the cable does not comprise any ground wire;

wherein the connecting portion comprises a first wing portion and a second wing portion, the first wing portion and the second wing portion extend in opposite directions, and the first wing portion and the second wing portion are riveted and fixed on the ground shielding layer;

wherein the connecting portion comprises a bridge portion connecting the first ground terminal and the second ground terminal, and a tail portion extending from the bridge portion;

and wherein the first wing portion and the second wing portion extend from two sides of the tail portion, respectively; and wherein the first wing portion and the second wing portion are both parallel to the bridge portion, a first slit is formed between the first wing portion and the bridge portion, and a second slit is formed between the second wing portion and the bridge portion.

9. The cable connector according to claim 8, wherein the signal wires and the signal terminals are fixed in a soldering manner, and the connecting portion and the ground shielding layer are fixed in a non-soldering manner.

10. The cable connector according to claim 8, wherein the terminal module comprises a first insulating block and a second insulating block, the conductive terminals are insert-molded with the first insulating block so as to form a first module, and the first module is insert-molded with the second insulating block.

11. The cable connector according to claim 10, wherein the first insulating block comprises a first hollow portion and a second hollow portion spaced apart from each other, each signal terminal comprises a cable connection portion exposed in the first hollow portion to electrically connect the signal wire, and the first wing portion and the second wing portion are exposed in the second hollow portion.

12. The cable connector according to claim 11, further comprising a first metal shield located on one side of the terminal module and a second metal shield located on the other side of the terminal module, the first metal shield and the second metal shield jointly clamp the terminal module, and the first metal shield is in contact with the second metal shield.

13. The cable connector according to claim 12, wherein the housing comprises a first side housing, a second side housing opposite to the first side housing, and a metal shell connecting the first side housing and the second side housing, the slot is formed on inner walls of the first side housing and the second side housing, and the first metal shield and the second metal shield are in contact with the metal shell.

14. A wire-to-board connector, comprising:

a housing having a slot;

a terminal module received in the slot, the terminal module comprising a plurality of groups of conductive terminals, at least one group of conductive terminals comprising two signal terminals, a first ground terminal located on one side of the signal terminals and a second ground terminal located on the other side of the signal terminals; and a cable comprising signal wires electrically connected to the signal terminals;

wherein the housing comprises a first side housing, a second side housing opposite to the first side housing, and a metal shell connecting the first side housing and the second side housing; the metal shell defines an opening;

wherein each conductive terminal comprises a circuit board mounting portion extending through the opening and for being mounted to a circuit board;

wherein the first ground terminal and the second ground terminal are of one-piece configuration; and the at least one group of conductive terminals comprises a connecting portion connecting the first ground terminal and the second ground terminal;

wherein the cable comprises a ground shielding layer wrapped around a periphery of the signal wires;

wherein the connecting portion is at least partially wrapped and fixed on the ground shielding layer; and wherein the first ground terminal and the second ground terminal are connected to form a U-shaped groove, and the two signal terminals at least partially extends into the groove.

15. The wire-to-board connector according to claim 14, wherein the connecting portion comprises a first wing portion and a second wing portion, the first wing portion and the second wing portion extend in opposite directions, and the first wing portion and the second wing portion are riveted and fixed on the ground shielding layer.

16. The wire-to-board connector according to claim 15, wherein the connecting portion comprises a bridge portion connecting the first ground terminal and the second ground terminal, and a tail portion extending from the bridge portion; and wherein the first wing portion and the second wing portion extend from two sides of the tail portion, respectively.

17. The wire-to-board connector according to claim 16, wherein the first wing portion and the second wing portion are both parallel to the bridge portion, a first slit is formed between the first wing portion and the bridge portion, and a second slit is formed between the second wing portion and the bridge portion.

18. The wire-to-board connector according to claim 15, wherein the terminal module comprises a first insulating block and a second insulating block, the conductive terminals are insert-molded with the first insulating block so as to form a first module, the first module is insert-molded with the second insulating block, the first insulating block comprises a first hollow portion and a second hollow portion spaced apart from each other, each signal terminal comprises a cable connection portion exposed in the first hollow portion to electrically connect the signal wire, and the first wing portion and the second wing portion are exposed in the second hollow portion.

19. The wire-to-board connector according to claim 14, wherein the signal wires and the signal terminals are fixed in a soldering manner, and the connecting portion and the ground shielding layer are fixed in a non-soldering manner.

20. The wire-to-board connector according to claim 14, wherein the circuit board mounting portion comprises a widened portion for being pressed into conductive holes of the circuit board and a through hole extending through the widened portion.

* * * * *